US006379177B1

(12) United States Patent
Chang

(10) Patent No.: US 6,379,177 B1
(45) Date of Patent: Apr. 30, 2002

(54) FLEXIBLE PRINTED CIRCUIT CONNECTOR WITH RELIABLE LATCHING MECHANISM

(75) Inventor: Jen Jou Chang, Yung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/705,987

(22) Filed: Nov. 3, 2000

(51) Int. Cl.[7] ..... H01P 13/631
(52) U.S. Cl. ..... 439/495
(58) Field of Search ..... 439/495, 260, 439/67, 77

(56) References Cited

U.S. PATENT DOCUMENTS 5,458,506 A * 10/1995 Yamaguchi et al. ..... 439/495
5,904,586 A * 5/1999 Takayasu ..... 439/495
6,129,573 A * 10/2000 Juntwait et al. ..... 439/495

* cited by examiner

*Primary Examiner*—Gary F. Paumen
(74) *Attorney, Agent, or Firm*—Wei Te Chung

(57) ABSTRACT

A flexible printed circuit (FPC) connector includes a substantially rectangular insulating housing (1), a plurality of contact elements (2) received in the housing, a pressure member (3) rotatably mounted on the insulating housing, and a pair of solder pads (4) for soldering to an printed circuit board. The insulating housing has a pair of support arms (11) on opposite sides thereof and a pair of latching keys (112) on the support arms. The pressure member has a body portion (30), a pair of latching arms (32) extending rearwardly from a top edge of the body portion, and a pair of rotation arms (34) extending lateraly from opposite sides of the body portion. A pair of recess portions (33) are defined between the body portion and the rotation arms allowing entrance of the latching keys therein.

1 Claim, 4 Drawing Sheets

FLEXIBLE PRINTED CIRCUIT CONNECTOR WITH RELIABLE LATCHING MECHANISM

FIELD OF THE INVENTION

The present invention generally relates to electrical connectors, and in particular to flexible printed circuit (FPC) connectors with reliable latching mechanisms.

BACKGROUND OF THE INVENTION

Various electrical connectors are used to terminate flexible printed circuits (FPCs). U.S. Pat. No. 5,458,506 discloses a conventional FPC connector which has an insulating housing and a pressure member for securing an FPC inserted in the housing. The housing has a pair of support members extending laterally from opposite sides thereof. The pressure member has a pair of support arms on opposite sides thereof for engaging a pair of bearing recesses on opposite sides of the support members. The pressure member rotates about the shaft portions formed on the support arms to move between an open position and a closed position.

However, the support arm has a weak structure and tends to be damaged after a period of use. Additionally, the support members extending laterally from the opposite sides of the housing to position the pressure member on the insulating housing are a disadvantage in consideration of minimizing the size of the FPC connector.

Hence, an improved FPC connector is needed to overcome the above-mentioned deficiencies of current FPC connectors.

BRIEF SUMMARY OF THE INVENTION

A main object of the present invention is to provide a flexible printed circuit (FPC) connector having a pressure member reliably mounted on a housing thereof.

Another object of the present invention is to provide an FPC connector having a low profile.

An FPC connector according to the present invention includes a substantially rectangular insulating housing, a plurality of contact elements received in the housing, a pressure member rotatably mounted on the housing, and a pair of solder pads mounted on the housing for soldering to a printed circuit board. The insulating housing has a pair of support arms on opposite sides thereof and a pair of latching keys respectively projecting on tops of the support arms. A pair of latching protrusions are formed on a rear end of the insulating housing opposite to each other. The pressure member has a body portion, a pair of latching arms extending rearwardly from a top edge of the body portion, and a pair of rotation arms projecting laterally from opposite sides of the body portion. A pair of recess portions are defined between the body portion and the rotation arms allowing entrance of the latching keys therein. Each latching arm has a latching tab for engaging a corresponding latching protrusion.

DETAILED DESCRIPTION OF THE INVENTION

Figure 1:
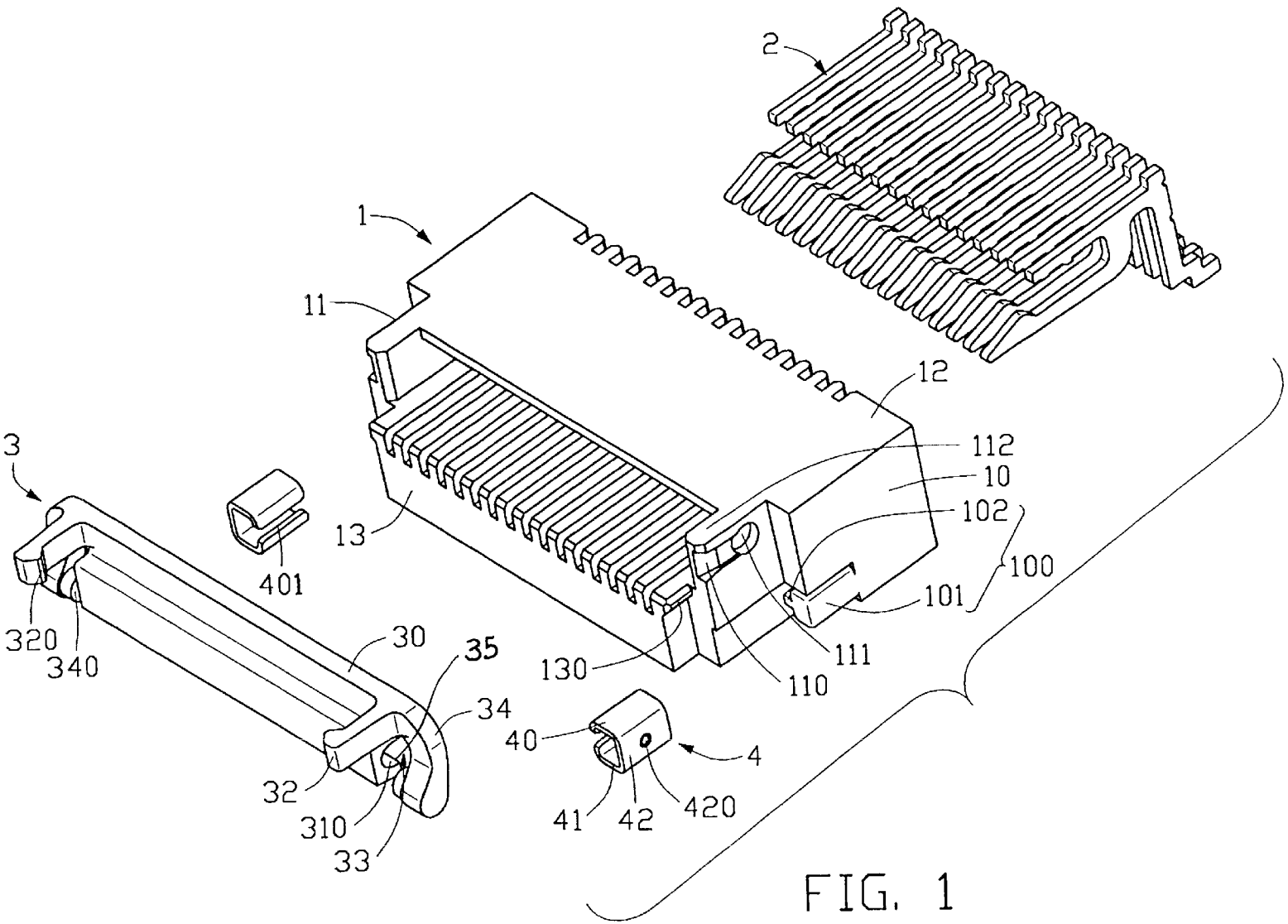
FIG. 1 is an exploded view of a flexible printed circuit (FPC) connector of the present invention.
Figure 2:
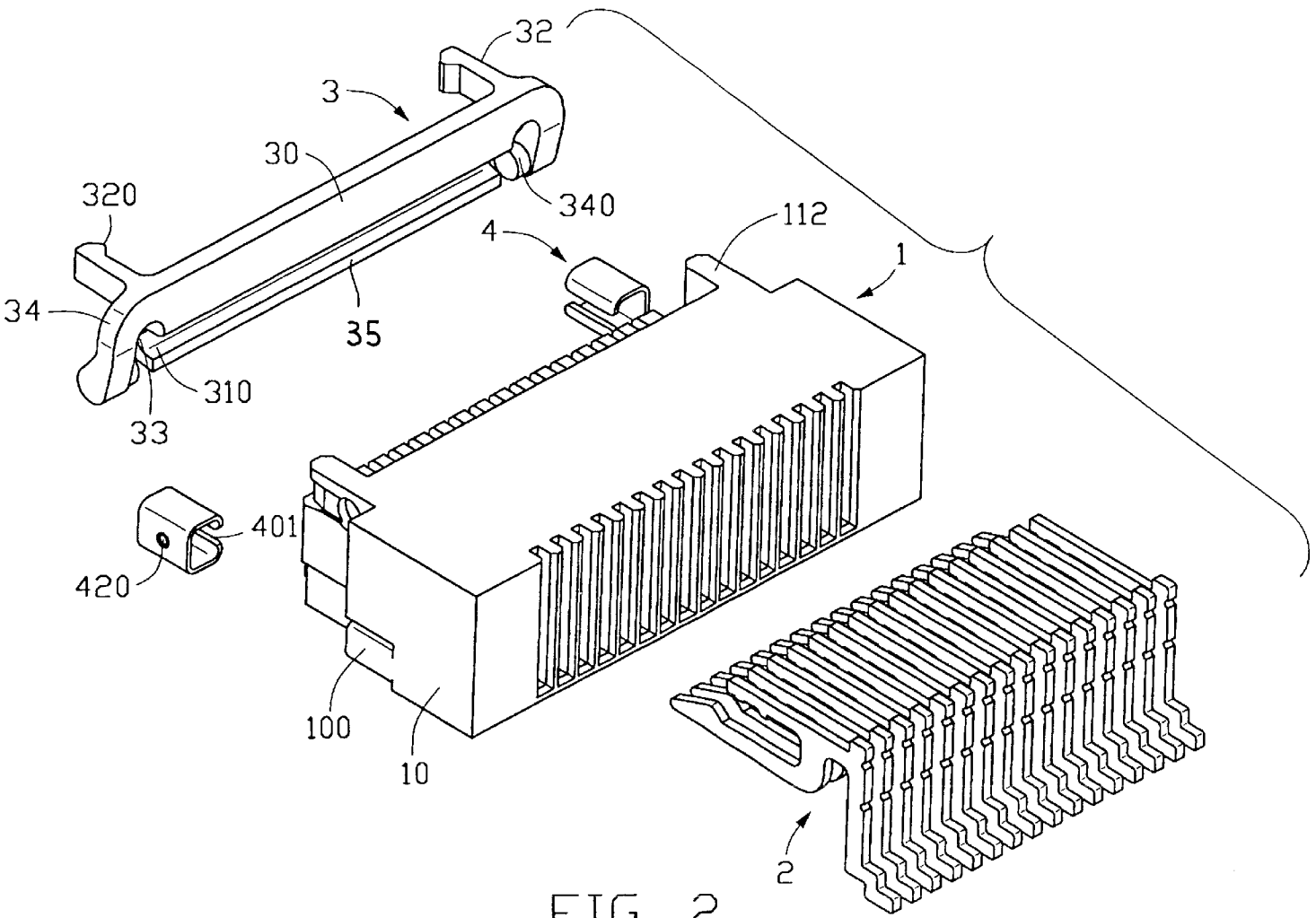
FIG. 2 is the FPC connector of FIG. 1 viewed from another aspect.
Figure 3:
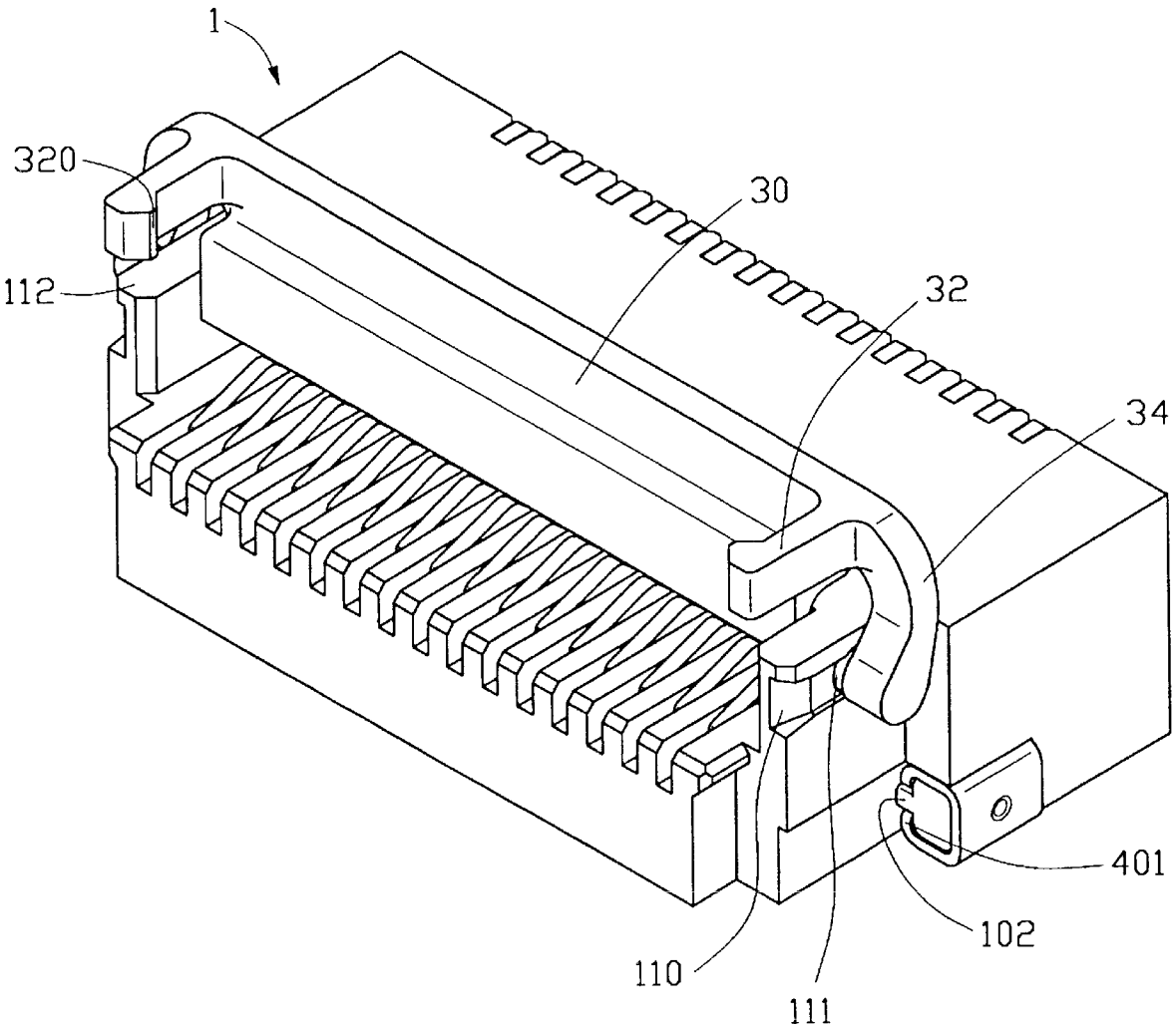
FIG. 3 is an assembled view of FIG. 1.

Referring to FIGS. 1, 2 and 3, a flexible printed circuit (FPC) connector according to the present invention includes a substantially rectangular insulating housing 1, a plurality of contact elements 2 received in the housing 1, and a pressure member 3 rotatably mounted on the housing 1. A pair of U-shaped solder pads 4 are mounted on the housing for facilitating soldering of the connector to a printed circuit board. The insulating housing 1 includes a top wall 12, a bottom wall 13 extending rearwardly beyond the top wall 12, and a pair of side walls 10 on opposite sides of the housing 1, which are integrally formed and commonly defining a cavity (not labeled) therein. A pair of support arms 11 respectively extend rearwardly from rear ends of the side walls 10. Each side wall 10 has a T-shaped latching block 100 formed on a lower portion thereof. Each T-shaped latching block 100 has a body block 101 and an elongated retention rib 102 inwardly projecting from the body block 101. A latching key 112 is formed on a top of each support arm 11. A pair of slide ways 110 are respectively defined in rear portions of the support arms 11, adjacent the latching keys 112. A hole 111 is defined in a front end of each slide way 110. A pair of latching protrusions 130 are formed on opposite sides of a rear end of the bottom wall 13.

Particularly referring to FIGS. 1 and 2, the pressure member 3 includes a body portion 30, a pair of latching arms 32 perpendicularly and rearwardly extending from a top edge of the body portion 30, and a pair of rotation arms 34 respectively projecting laterally from opposite sides of the body portion 30. A pair of recess portions 33 are defined between the body portion 30 and the rotation arms 34. A shaft portion 340 projects inwardly from an inner surface of each rotation arm 34. A latching tab 320 projects inwardly from a rear end of each latching arm 32. A semi-circular groove 310 is defined in a front portion of the body portion 30. A front edge 35 is defined on the front portion of the body portion 30.

Each solder pad 4 includes an upper portion 40, a connecting portion 42 downwardly depending from an edge of the upper portion 40, and a solder portion 41 extending perpendicularly and inwardly from a lower edge of the connecting portion 42. A pair of buckles 401 respectively depend fromfree edges of the upper portion 40 and the solder portion 41, pointing towards each other. A protuberance 420 projects inwardly from an inner surface of the connecting portion 42.

Referring to FIG. 3, in assembly, the contact elements 2 are received in the housing 1. The pressure member 3 is rotatably mounted to the insulating housing 1. The shaft portion 340 of each rotation arms 34 slides through a corresponding slide way 110 to engage the hole 111 of a corresponding support arm 11. Each latching key 112 of the insulating housing 1 enters into a corresponding recess portion 33. Therefore a reliable connection between the housing 1 and the pressure member 3 is obtained. Each solder pad 4 is mounted to a corresponding latching block 100, with the upper portion 40 and the solder portion 41 thereof respectively abutting a top and a bottom surfaces of the body block 101 of the latching block 100, and the buckles 401 thereof crimping the retention rib 102 therebetween. The protuberance 420 abuts against an outer surface of the body block 101. The solder portion 41 is soldered to the printed circuit board (not shown).

Figure 5:
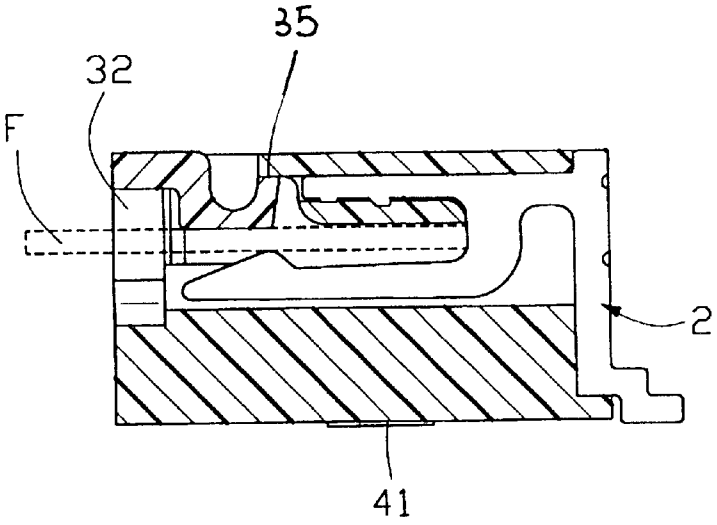
FIG. 5 is a cross-sectional view of the connector and an FPC being fully received in the connector, wherein the pressure member of the connector is in a closed position.
Figure 4:
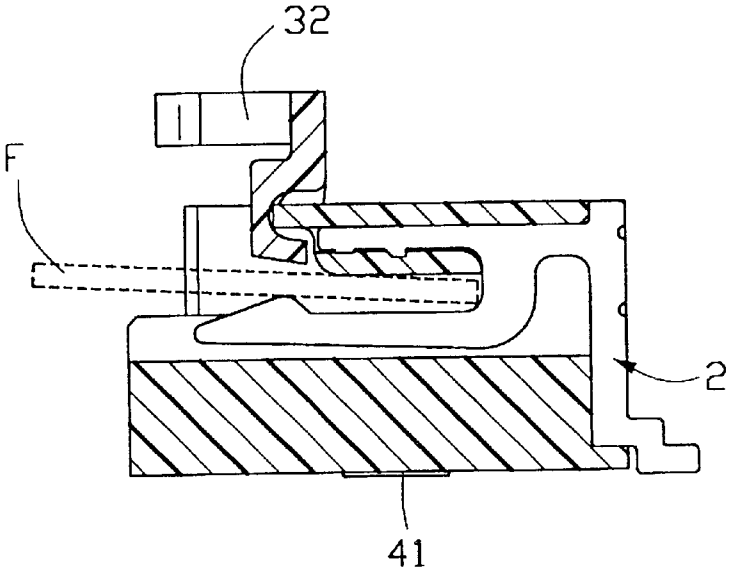
FIG. 4 is a cross-sectional view of the connector and an FPC being fully received in the connector, wherein a pressure member of the connector is in an open position.

Referring to FIG. 4, when the pressure member 3 is turned to the open position, an FPC F is inserted between the pressure member 3 and contact portions (not labeled) of the contact elements 2. The semi-circular groove 310 of the pressure member 3 receives a rear edge of the top wall 12 of the insulating housing 1. FIG. 5 shows the pressure member 3 turned to the closed position. The latching tabs 320 of the pressure member 3 engage the latching protrusions 130 of the bottom wall 13 of the insulating housing 1. The pressure member 3 presses the FPC F against the contact elements 2, so that the circuit conductors (not shown) on a lower surface of the flexible board F are brought into contact with the contact elements 2. The front edge 35 abuts against the upper portion of the housing 1 to stop further rotation of the pressure member 3.

It will be understood that the invention may be embodied in other special forms without departing from the spirit or central characteristic thereof. The present examples and embodiment therefore are to be considered in all respects as illustrative and not restrictive, and the invention is not to be limited to the details given herein.

What is claimed is:

1. A flexible printed circuit (FPC) connector comprising:

a substantially rectangular insulating housing having a pair of support arms on opposite sides thereof, and a pair of latching keys respectively on upper surfaces of the support arms;

a plurality of contact elements received in the housing; and a pressure member having a body portion, a pair of latching arms extending from the body portion, and a pair of rotation arms extending laterally from opposite sides of the body portion, a pair of recess portions being formed between the body portion and the rotation arms allowing entrance of the latching keys therein;

wherein each said support arm of the insulating housing defines a hole, and wherein each rotation arm of the pressure member forms a shaft portion projecting from an inner side thereof for engaging with a corresponding hole;

wherein each support arm defines a slide way for facilitating the engagement of the shaft portion with the corresponding hole;

further comprising a pair of U-shaped solder pads secured t the insulating housing, each solder pad including an upper portion, a connecting portion downwardly depending from an edge of the upper portion, and a solder portion extending perpendicularly and inwardly from a lower edge of the connecting portion, a pair of buckles respectively depending from free edges of the upper portion and the solder portion and pointing towards each other, a ptotuberance projecting inwardly from an inner surface of the connecting portion;

wherein a pair of T-shaped latching blocks are respectively formed on lower portions of opposite sides of the insulating housing, each latching block having a body block and an elongated retention rib inwardly projecting from the block, and the protuberance of the solder pad abuts against the outer surface of a corresponding body block;

wherein each latching arm has a latching tab projecting inwardly from an inner surface thereof, and the insulating housing has a bottom wall and a pair of proturusions, each protrusion being formed on a rear end of the bottom wall for engaging with the latching tab;

wherein the insulating housing has a top wall, and the pressure member defines a semi-circular groove in a front portion of the body for receiving a rear edge of the top wall.

* * * * *